US005768087A

United States Patent [19]

Vernitskiy

[11] Patent Number: 5,768,087

[45] Date of Patent: Jun. 16, 1998

[54] METHOD AND APPARATUS FOR AUTOMATICALLY CLEANING IONIZING ELECTRODES

[75] Inventor: Grigoriy Vernitskiy, San Francisco, Calif.

[73] Assignee: Ion Systems, Inc., Berkeley, Calif.

[21] Appl. No.: 743,987

[22] Filed: Nov. 5, 1996

[51] Int. Cl.[6] ..... H01T 19/00

[52] U.S. Cl. ..... 361/230; 15/256.5

[58] Field of Search ..... 361/212, 213, 361/225, 229, 230; 250/324–326; 134/18, 33, 56 R; 15/256.5

[56] References Cited

U.S. PATENT DOCUMENTS

| | | | |
|---|---|---|---|
| 4,123,154 | 10/1978 | Fisher | 361/225 |
| 4,734,580 | 3/1988 | Rodrigo et al. | 250/324 |
| 5,017,876 | 5/1991 | Wright et al. | 324/464 |
| 5,018,944 | 5/1991 | Bielecki et al. | 15/256.5 |
| 5,153,811 | 10/1992 | Rodrigo et al. | 361/231 |
| 5,450,186 | 9/1995 | Lundy | 15/256.5 |
| 5,493,383 | 2/1996 | Pozniakas et al. | 15/256.5 |

OTHER PUBLICATIONS

Simco, "Worldwide Leaders in Static Control", Product Catalog, 1996. (Original).

*Primary Examiner*—Fritz Fleming

*Attorney, Agent, or Firm*—Fenwick & West LLP

[57] ABSTRACT

A cleaning device is coupled to a fan used for creating air flow across ionizing electrodes. The cleaning device rotates with the propeller and includes a cover adapted for mounting on the propeller hub. A stand is attached to the cover and has a rod that is slidably installed into a hole in the stand. A brush and a weight are attached to the opposite ends of the rod, and a compression spring is disposed about the rod and positioned on the side of the stand opposite the weight. A counterweight assembly is also attached to the stand for dynamically balancing the cleaning device during a full cycle of operation. The counterweight assembly includes a counterweight and an extension spring that are slidably mounted about a rod attached to the cleaning assembly. When the fan is turned off or operates below the speed of normal operation of the ionizing device, the circle of rotation of the ends of the brush overlaps the circle formed by the emitter points of the discharge electrodes and makes possible a sweeping motion of the brush which dislodges the dirt and the dust from the emitter points of the electrodes. When the fan rotates with normal operating speed the brush assembly is fully inside the cover, and the weight and the counterweight rest next to the wall of the cover.

21 Claims, 8 Drawing Sheets

METHOD AND APPARATUS FOR AUTOMATICALLY CLEANING IONIZING ELECTRODES

BACKGROUND OF THE INVENTION

1. Field of the Invention

The present invention relates generally to the cleaning of emitter points on discharge electrodes in ionizing devices, and more particularly, to a cleaning device for automatically cleaning emitter points without interruption of normal ionizer operation.

2. Description of the Related Art

Ionizing devices that function as static eliminators or neutralizers may produce both polarities of ions that combine with and neutralize oppositely charged surfaces. Such devices are useful for maintaining electrostatically neutral conditions usually associated with the manufacture of electronic devices, especially semiconductors. Because these ionizers use discharge electrodes that produce an electric field, they tend to accumulate foreign particles at their emitter points or edges. This particle accumulation can cause an excess emission of ions of one polarity or the other, i.e., ion imbalance, whereby the area at which both polarities of ions are directed tends to become charged rather than electrostatically neutral.

Particle accumulation is especially evident in ionizing devices where the emitter points are contained within a housing having front and back surfaces that are enclosed by a grille or screen. In such instances, access to the discharge electrodes usually requires disassembly of the enclosed housing and/or use of special cleaning tools. In other instances, a special cleaning device must be installed into the ionizing device itself to clean emitter points manually or with energy sources other than employed for normal ionizer operations or the consequence of such operations.

Accordingly, there remains a need for an automated cleaning device that functions during normal ionizer operation, is substantially free of maintenance, and requires no additional manpower or cleaning time.

SUMMARY OF THE INVENTION

In accordance with the present invention, a cleaning device for automatically cleaning dust and dirt from ionizing electrodes is incorporated into an ionizer by, for example, attaching the device to the hub of a built-in fan propeller which is used to generate air flow across discharge electrodes. The cleaning device generally comprises a brush assembly, a weighted portion, and a restoring mechanism. The restoring mechanism is responsive to a first force which at a first speed of the fan biases the brush assembly away from the axis of rotation of the fan (i.e. into a position that results in a cleaning of the ionizing electrodes). An exemplary first speed is one below the speed of the fan during normal operation. The weighted portion is responsive to a second force which at a second speed of the fan prevents cleaning by biasing the brush assembly towards the axis of rotation of the fan (i.e. away from the ionizing electrodes). An exemplary second speed is the normal operating speed of the fan.

In further accordance with the present invention, a method is employed of automatically cleaning ionizing electrodes in an ionizer, wherein a cleaning assembly including a brush assembly is mounted atop the propeller of a fan forming part of the ionizer. The method comprises the steps of responding to a first force so that when the fan rotates at a first predetermined speed the brush assembly is biased into a cleaning position away from the axis of rotation of the fan wherein it cleans the ionizing electrodes; and responding to a second force such that when the fan rotates at a second predetermined speed the brush assembly is biased towards the axis of rotation of the fan wherein it does not clean the ionizing electrodes.

The present invention is advantageous because it allows the emitter points to be cleaned without interrupting the normal operation of the ionizer, is easily integrated into existing ionizer designs and is constructed from readily available materials.

BRIEF DESCRIPTION OF THE DRAWINGS

The present invention has other, advantages and features which will be more readily apparent from the following detailed description of the invention and the appended claims, when taken in conjunction with the accompanying drawings, in which:

DETAILED DESCRIPTION OF THE INVENTION

Figure 1:
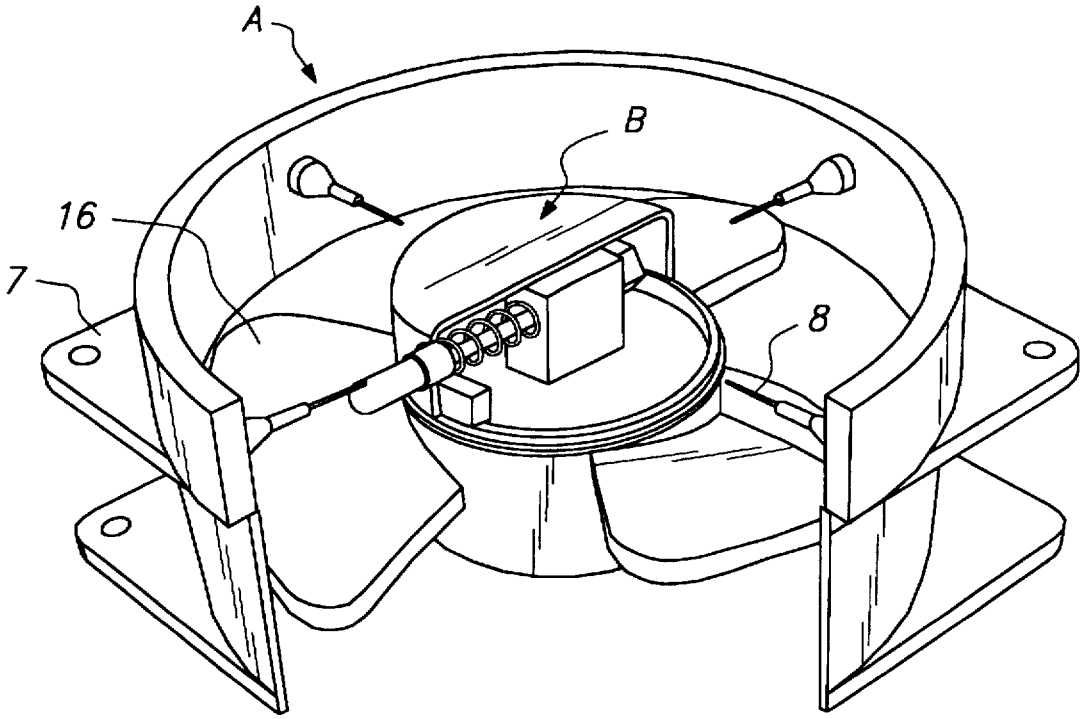
FIG. 1 is a perspective view (and partly broken away) of an ionizer having a fan with a first embodiment of the built-in automated cleaning device attached thereto.

Referring to FIG. 1, a perspective view (and partly broken away) of a first embodiment of a built-in automated cleaning device B constructed in accordance with the present invention is shown. The cleaning device B is preferably integrated into an ionizer A having a plurality of discharge electrodes 8 that are susceptible to the accumulation of dust and dirt.

The cleaning device B is attached to the hub of a propeller 16 forming part of a fan 7. The fan 7 is capable of blowing a stream of air over the electrodes 8. The electrodes 8 are adjacently spaced along a common circular path and are typically attached to a high voltage power source. A corona discharge produces ions that are emitted from the emitter points of the electrodes 8. When the fan 7 is turned off or operates below its normal speed in the operation of the ionizer A (including periods where the fan is accelerating towards and decelerating from the normal speed), the cleaning device B dislodges dirt and dust that has accumulated on the emitter points of the electrodes 8. Preferably, the dirt and dust are dislodged through contact with the brush.

Figure 2:
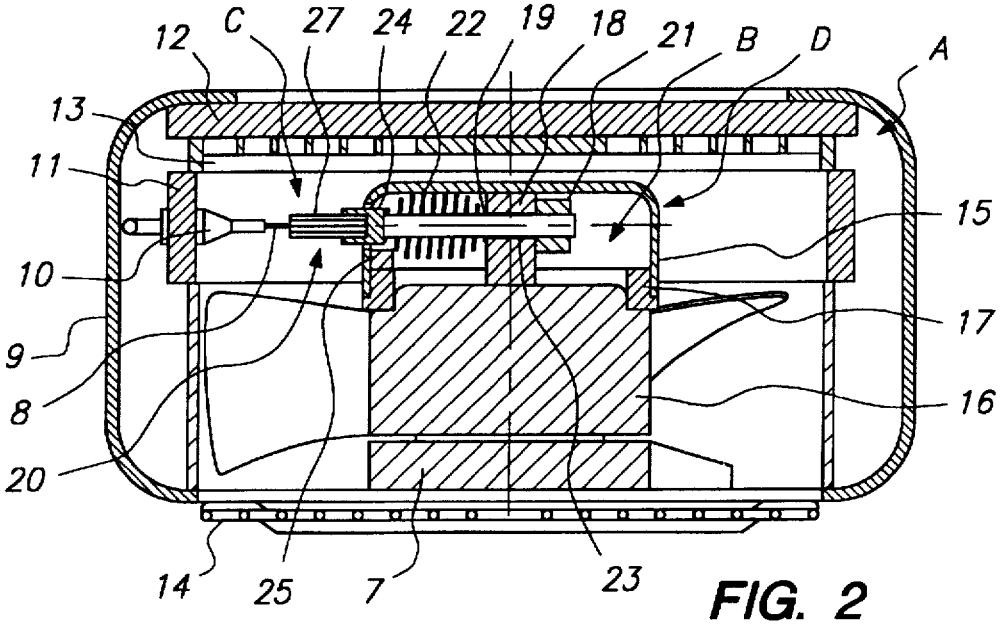
FIG. 2 is a sectional view of the first embodiment taken along a line perpendicular to the plane of the ionizing electrodes with the fan turned off.
Figure 3:
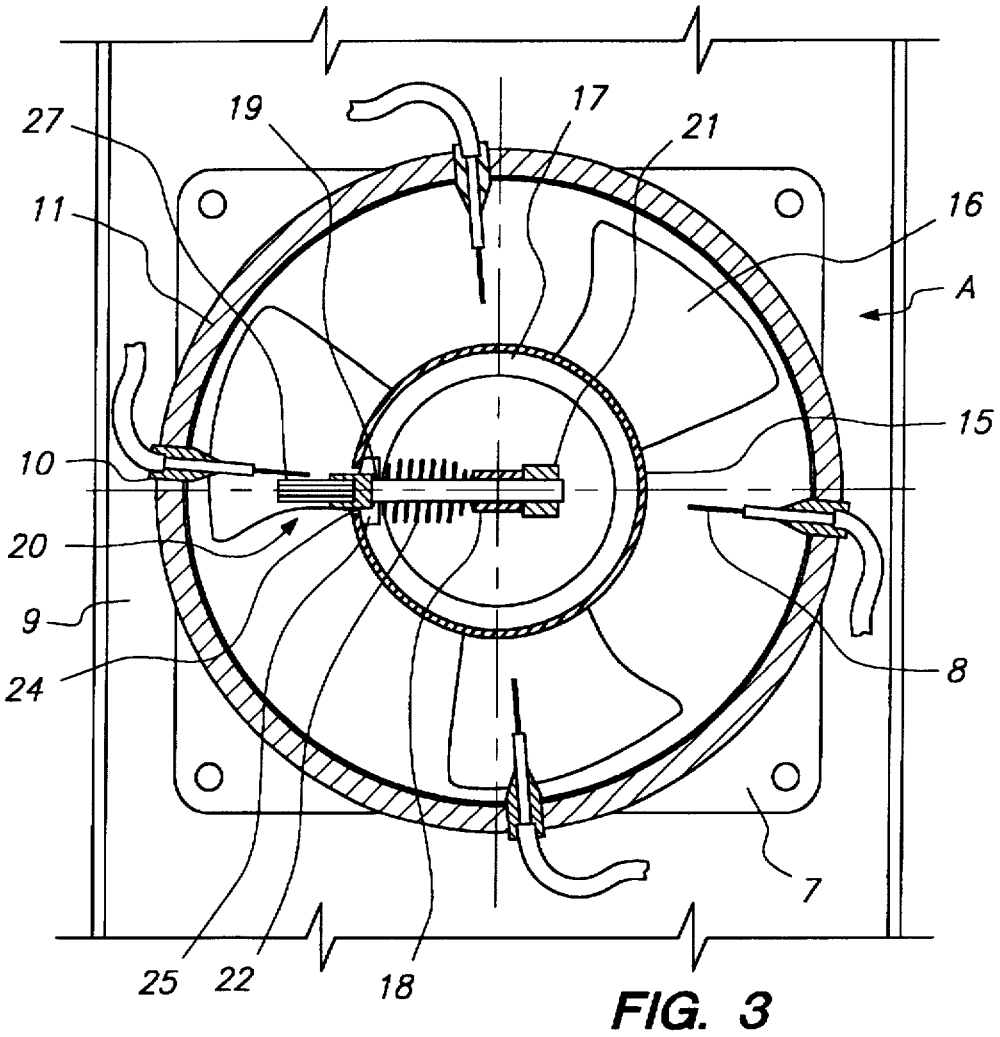
FIG. 3 is a sectional view of the first embodiment taken along the plane of the ionizing electrodes with the fan turned off.

Referring now to FIG. 2 and FIG. 3, sectional views of the first embodiment taken along plane of the ionizing electrodes 8 (FIG. 3) and along a line perpendicular to the plane of the ionizing electrodes 8 (FIG. 2) with the fan 7 turned off are shown. The cleaning device B comprises a cleaning assembly C and an enclosure assembly D. The cleaning assembly C comprises a rod 19, a stand 18, a brush assembly 20, a weight 21, and a cylindrical compression spring 22. The brush assembly 20 comprises a ferrule 24 and a brush 27. The enclosure assembly D comprises a cover 15, a centering ring 17 and a counterweight 25. The counterweight 25 can be mounted on the inner surface of the cover 15. Additionally, the stand 18 can be integrated with the cover 15 as a single part. The ionizer A has a top finger guard 13, a bottom finger guard 14, and a filter 12. Since the present invention is integrated into the ionizer A, it is capable of automatically cleaning the electrodes without requiring removal of the filter 12 and the fingerguards 13, 14. Various conventional ionizer A configurations will have equipment that would need to be removed without the present invention. For example some configurations provide an air deflector which would need to be removed to clean the ionizing electrodes 8 without the present invention.

The cleaning device is attached to the hub of the propeller 16 and actuated by any suitable driving means (e.g., fan motor), or by the movement of rotating air. The ionizing electrodes 8 are installed into emitter holders 10 extending through a supporting ring 11 attached to the top of the fan 7. The stand 18 is attached to the center of the cover 15 from inside or, alternatively, is incorporated as part of an injection-molded cover. The cover 15 is attached to the ring 17 or alternatively has a plurality of legs (not shown) for centering the cleaning device B on the propeller 16 of the fan 7. The artisan will recognize the various alternatives for centering the cleaning device B. The cleaning device B is secured to the propeller 16 by using double-stick tape or any other suitable means known in the art.

Referring now to the cleaning assembly C, the rod 19 is slidably installed into a hole 23 in the stand 18. The brush assembly 20 and the weight 21 are attached to the opposite ends of the rod 19. The compression spring 22 is disposed about the rod 19 and is positioned on the same side of the stand 18 as the brush 20. There is a hole in the cover 15 on the same axis as the hole 23 in the stand 18. The hole has an opening of sufficient radius to let the ferrule 24 and the brush 27 of the brush assembly 20 travel outside and inside the cover 15.

Figure 6A:
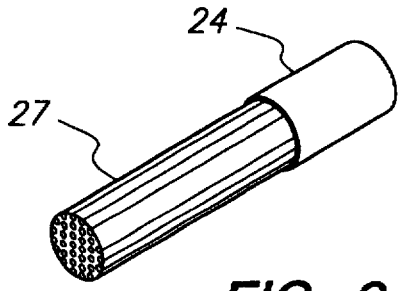
FIG. 6A is a perspective view of an embodiment of the brush in accordance with the present invention.
Figure 6B:
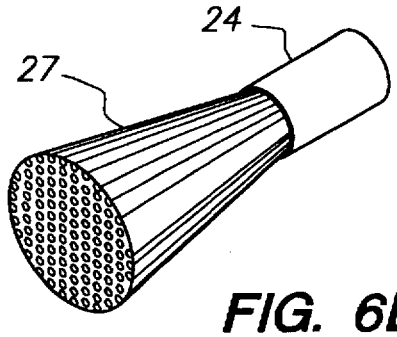
FIG. 6B is a perspective view of another embodiment of the brush in accordance with the present invention.

The brush 27 can be a textile flap or any pliable or compressible material such as natural or synthetic rubber. Preferably, the brush 27 is a bristle brush made from natural materials such as goat or horse hair. Alternatively, a synthetic bristle brush made from materials such as nylon can be provided. Various configurations can be provided for the brush 27. Referring to FIG. 6A, the brush 27 can be cylindrical in shape. Referring to FIG. 6B, the brush 27 can also be cone shaped. Cone brushes provide less resistance when applied to objects in a transverse direction than cylindrical brushes. Thus, cone brushes allow the use of a stiffer bristle material, or relatively long periods of brushing, or both due to lower energy consumption.

In accordance with the operation of this embodiment, when the fan 7 is turned off or operates below its normal speed in the operation of the ionizer A (FIGS. 2 and 3), the circle of rotation of the end for the brush 27 of the brush assembly 20 overlaps the circle formed by the emitter points of the electrodes 8 and makes possible the sweeping motion of the brush 27 which dislodges dirt and dust from the emitter points of the electrodes 8. Thus, when the fan 7 is turned off or operating below its normal speed in the operation of the ionizer A, the brush 27 is in the cleaning position. The force of the compression spring 22 causes the weight 21 to be next to the stand 18 and thus, biases the brush 27 away from the axis of rotation of the fan and towards the cleaning position.

Figure 4:
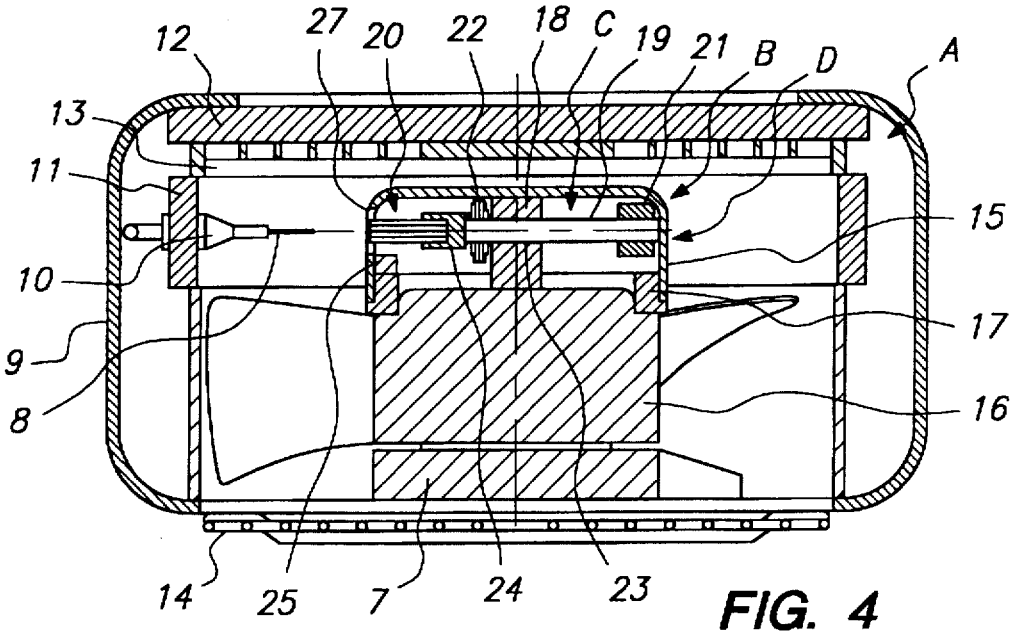
FIG. 4 is the same view as FIG. 2 but with the fan turned on and the propeller rotating at its normal operating speed.
Figure 5:
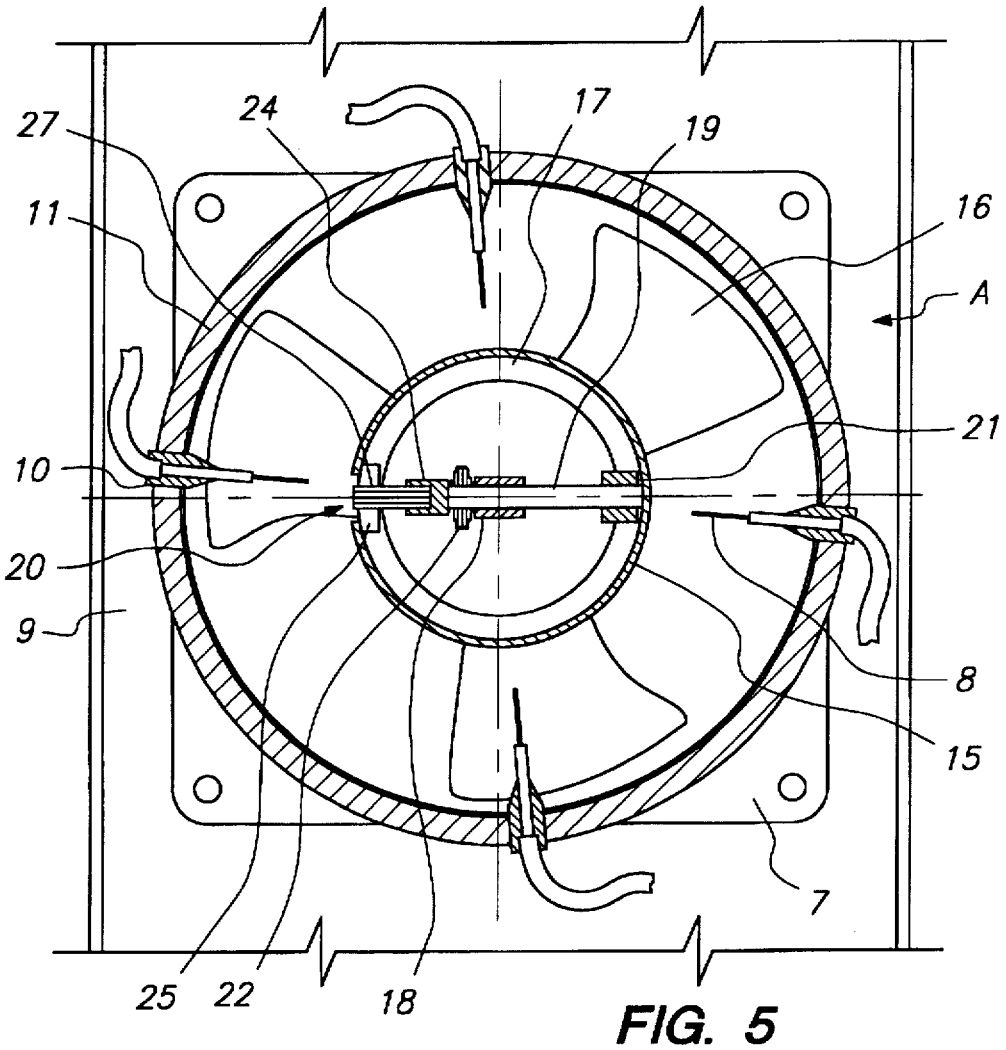
FIG. 5 is the same view as FIG. 3 but with the fan turned on and the propeller rotating at normal operating speed.

Referring now to FIG. 4 and FIG. 5 together, sectional views taken along plane of the ionizing electrodes 8 (FIG. 5) and along a line perpendicular to the plane of the ionizing electrodes 8 (FIG. 4) with the fan 7 turned on and at its normal operating speed are shown. When the fan 7 accelerates and gains speed, centrifugal force moves the weight 21 outward from the axis of rotation of the fan 7 and the brush assembly 20 moves inward from the electrodes 8 and into the cover 15, simultaneously compressing the spring 22. When the fan 7 rotates with normal operating speed, the brush assembly 20 is fully inside the cover 15, and the weight 21 rests next to the wall of the cover 15. Thus, in this embodiment the centrifugal force is a force which moves the brush 27 towards the axis of rotation of the fan 7 and thus, out of the cleaning position and into a normal operating position.

Thus, the brush 27 dislodges dirt and dust that has accumulated on the emitter points of the electrodes 8 when the fan operates at a first speed (such as when the fan 7 is off or when the fan 7 operates at a speed below its normal speed in the operation of the ionizer A) but does not contact the emitter points of the electrodes 8 at a second speed (such as its normal speed in the operation of the ionizer A).

The materials for constructing the cleaning device B should be selected to provide cleaning at the first speed and prevent cleaning at the second speed as well as to promote dynamic balancing in the operation of the ionizer A. The artisan will recognize the various alternative configurations, but the following rules should be applied in material selection: the center of gravity of the cleaning assembly C should be positioned between the axis of rotation of the fan 7 and weight 21 when the fan 7 is turned off and not rotating; the centrifugal force applied to the cleaning assembly C when the fan 7 is rotating at a speed above that desired for cleaning (e.g. normal operating speed, the second speed) should exceed the sum of the spring 22 recovery force and the force of friction in the hole 23 in the stand 18; and the spring 22 recovery force applied to the cleaning assembly C when the fan 7 is rotating at a speed desired for cleaning (e.g. the first speed) and down to a complete stop should exceed the sum of centrifugal force applied to the cleaning assembly C and the force of friction in the hole 23 in the stand 18.

In FIGS. 1–5, the counterweight 25 is permanently mounted on the interior wall of the cover 15 and is sized such that the cleaning device B is dynamically balanced when the fan 7 operates at the speed of normal ionizer A operation.

Referring now to FIGS. 7–10 an embodiment of the present invention wherein the cleaning device B provides for dynamic balancing during a full cycle of operation is shown. This feature is provided by substituting a counterweight assembly E for the permanent counterweight 25 described with reference to FIGS. 1–5.

The counterweight assembly E comprises a rod 28, a counterweight 29 and an extension spring 30. The rod 28 is attached to the stand 18 and cover 15 and is positioned directly under the cleaning assembly C rod 19. The counterweight 29 is attached to the extension spring 30. The rod 28 extends through a hole in the counterweight 29 and a hole in the extension spring 30 which is positioned between the counterweight 29 and the stand 18. Because of the holes, the extension spring 30 and the counterweight 29 can slide along the rod 28.

Figure 7:
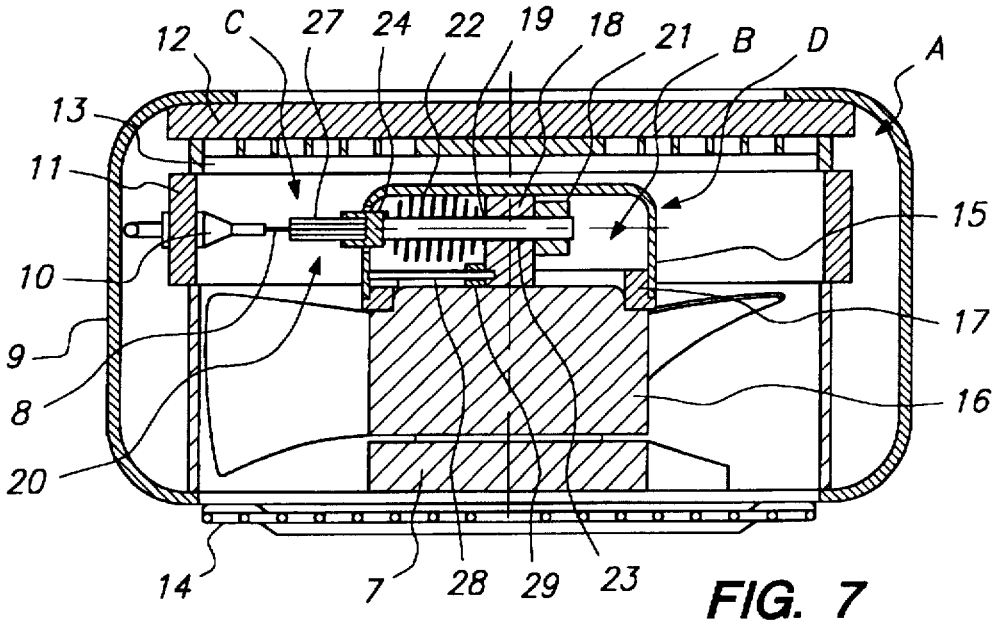
FIG. 7 is the same view as FIG. 2 but includes an embodiment of a self-balancing counterweight assembly.
Figure 8:
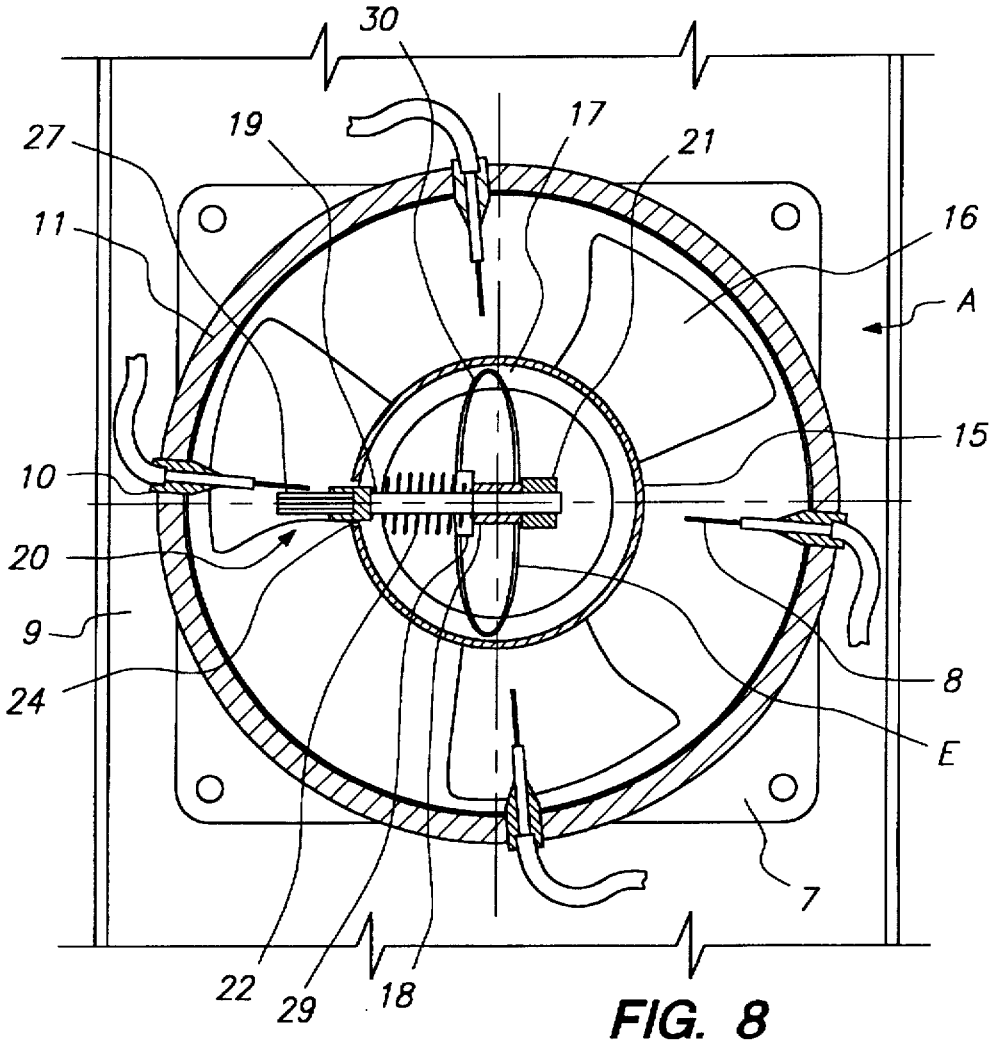
FIG. 8 is the same view as FIG. 3 but includes an embodiment of a self-balancing counterweight assembly.
Figure 9:
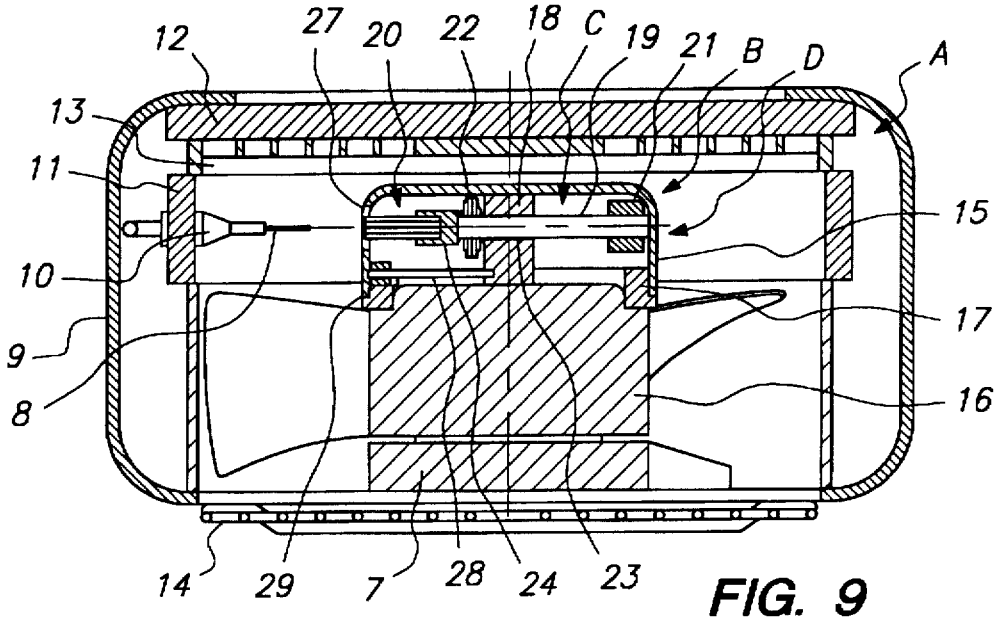
FIG. 9 is the same view as FIG. 4 but includes an embodiment of a self-balancing counterweight assembly.
Figure 10:
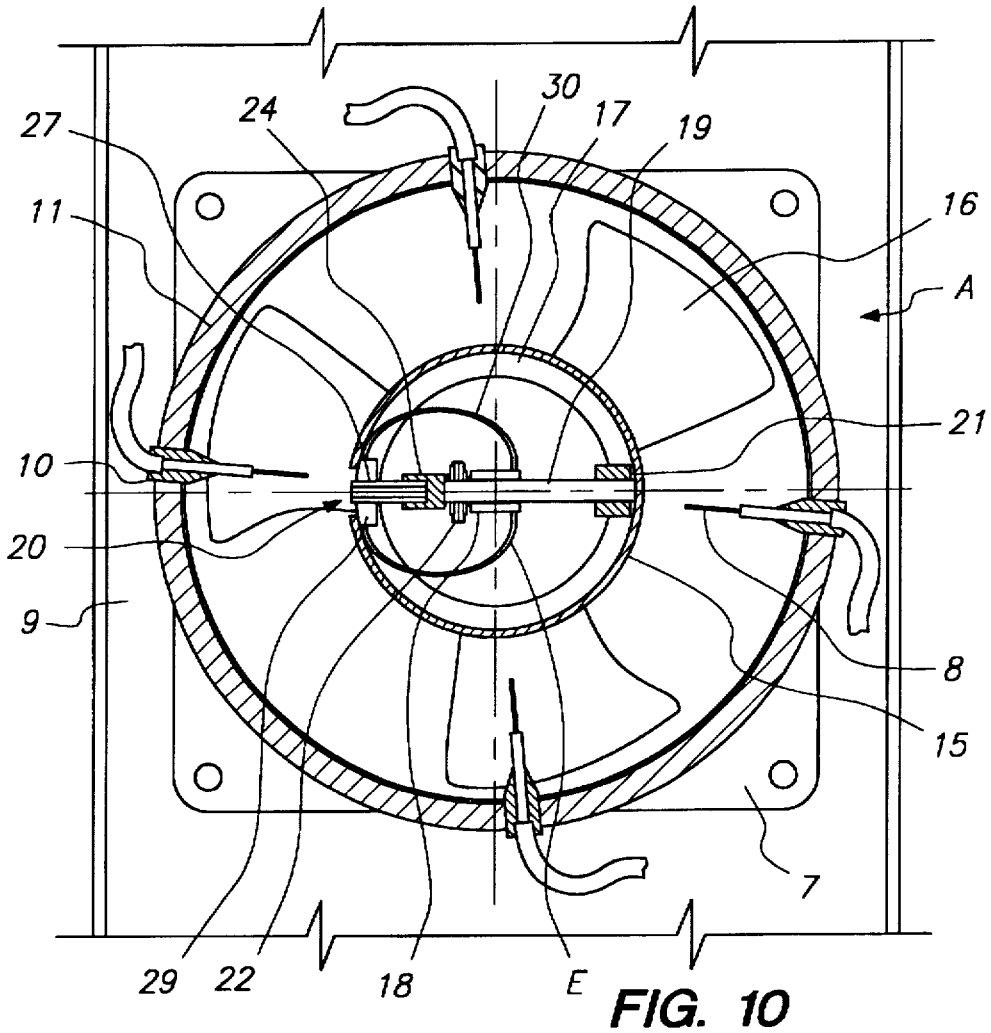
FIG. 10 is the same view as FIG. 5 but includes an embodiment of a self-balancing counterweight assembly.

As shown in FIGS. 7 and 8, when the fan 7 is turned off the extension spring 30 is released and free. Therefore, the counterweight 29 is next to the stand 18. When the fan 7 accelerates and gains speed, the counterweight 29 moves outward from the stand 18 to the wall of the cover 15, pulling out the extension spring 30. As shown in FIGS. 9 and 10 when the fan 7 rotates with normal operating speed in the operation of the ionizer A, the counterweight 29 rests next to the wall of the cover 15. The materials for constructing this embodiment of the cleaning device B should be selected to ensure that the center of gravity of the cleaning device is in the axis of rotation of the fan 7 during a full cycle of operation.

Other than the introduction of the counterweight assembly E which provides dynamic balancing during a full cycle of operation, the embodiment of FIGS. 7–10 is similar to the embodiment of FIGS. 1–5. Specifically, the cleaning device B comprises a cleaning assembly C and an enclosure assembly D. The cleaning assembly C comprises a rod 19, a stand 18, a brush assembly 20, a weight 21, and a cylindrical compression spring 22. The brush assembly 20 comprises a ferrule 24 and a brush 27. The enclosure assembly D comprises a cover 15 and a centering ring 17, but does not include a permanently mounted counterweight as provided in the embodiment of FIGS. 1–5.

The cleaning device B is attached to the hub of the propeller 16 and actuated by any suitable driving means (e.g., fan motor), or by the movement of rotating air, and the ionizing electrodes 8 are installed into emitter holders 10 extending through a supporting ring 11 attached to the top of the fan 7. The preferences for the cleaning device B, the stand 18, cover 15, and ring 17 are as provided in the first embodiment.

For the cleaning assembly C, the rod 19 is slidably installed into the hole 23 in the stand 18. The brush 20 and the weight 21 are attached to the opposite ends of the rod 19. The compression spring 22 is disposed about the rod 19 and is positioned on the same side of the stand 18 as the brush 20. There is a hole in the cover 15 on the same axis as the hole 23 in the stand 18. The hole has an opening of sufficient radius to let the ferrule 24 and the brush 27 of the brush assembly 20 travel outside and inside the cover 15.

Similar to the description provided with reference to FIGS. 1–5, when the fan 7 is turned off or operates below its normal speed in the operation of the ionizer A (FIGS. 7 and 8), the brush 27 is in a cleaning position wherein the circle of rotation of the end of the brush 27 of the brush assembly 20 overlaps the circle formed by the emitter points of the electrodes 8 and makes possible the sweeping motion of the brush 27 which dislodges dirt and dust from the emitter points of the electrodes 8. The force of the compression spring 22 causes the weight 21 to be next to the stand 18 and therefore biases the brush 27 towards the cleaning position. When the fan 7 accelerates and gains speed, centrifugal force moves the weight 21 outward from the axis of rotation of the fan 7 and the brush assembly 20 moves inward from the electrodes 8 and into the cover 15, simultaneously compressing the spring 22. When the fan 7 rotates with normal operating speed (FIGS. 9 and 10), the brush assembly 20 is fully inside the cover 15, and the weight 21 rests next to the wall of the cover 15. Thus, the centrifugal force is a force which moves the brush 27 towards the axis of fan rotation and thus, out of the cleaning position. The materials for constructing the cleaning device B should be selected according to the preferences and rules provided with reference to the description of FIGS. 1–5.

Figure 11:
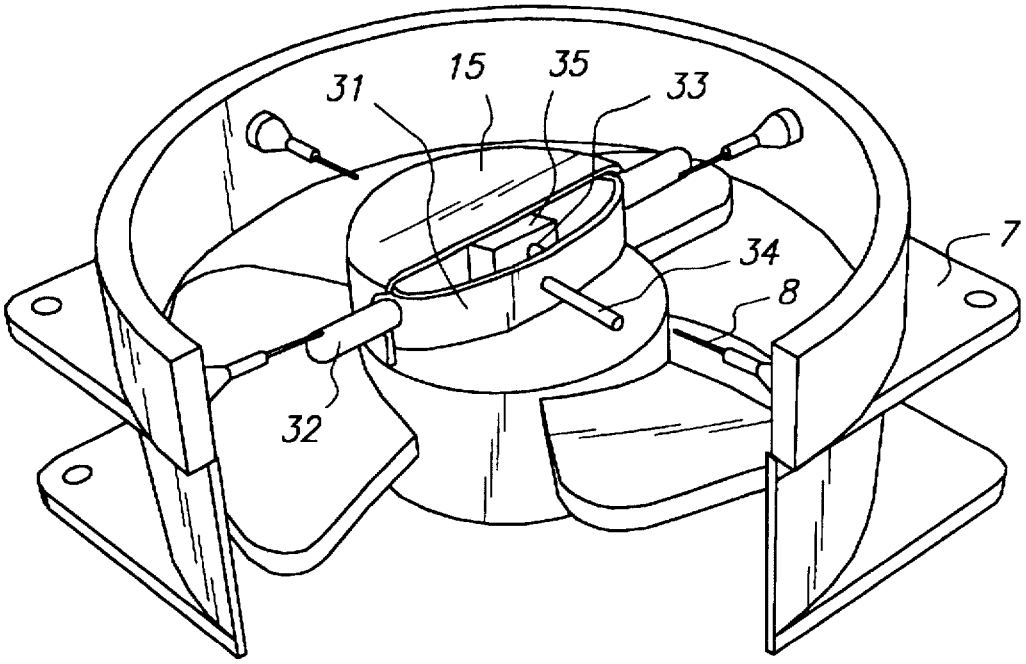
FIG. 11 is a perspective view (and partly broken away) of a second embodiment of the present invention with the fan turned off.

Referring now to FIG. 11, a perspective view (and partly broken away) of a second embodiment of the present invention with the fan 7 turned off is shown. pair of brushes 32 attached to the outside surface of the elliptical spring (major axis) and a pair of weights 33 attached to the inside surface of the elliptical spring (minor axis). A rod 34 protrudes through the stand 18, the spring 31, and the weights 33. The elliptical spring 31 with the weights 33 can slide along the rod 31.

Figure 12:
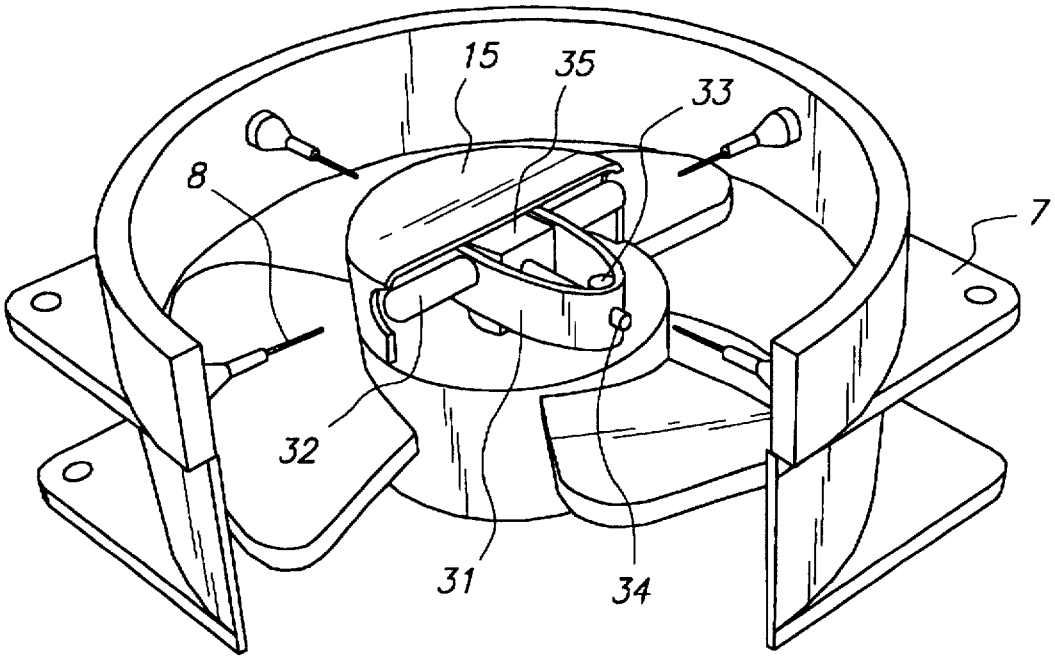
FIG. 12 is the same view as FIG. 11 but with the fan turned on and the propeller rotating at its normal operating speed.

Referring now to FIG. 12, the same view as FIG. I I but with the fan 7 turned on and the propeller 16 rotating at its normal operating speed is shown. When the fan 7 is turned off, accelerates from the off condition, or slows down below the speed of normal operation of the ionizer A, the circle of rotation of the ends of the brushes 32 overlaps the circle formed by the emitter points of the electrodes 8 and makes possible the sweeping motion of the brushes 32 which dislodges dirt and dust from the emitter points of the electrodes 8. At the same time, the spring 31 is released and free, and the weights 33 are next to the stand 18. When the fan 7 continues to accelerate and gain speed, centrifugal force starts to move the weights 33 out from the axis of rotation of the propeller 16 thereby changing the shape of the elliptical spring 31 (i.e., the major axis of the elliptical spring 31 becomes the minor axis of the elliptical spring 31 and vice-versa), moving brushes 32 inward from the electrodes 8 and into the cover 15. When the fan 7 rotates with the normal operating speed, the brushes 32 are fully inside the cover 15 and the weights 33 rest next to the wall of the cover 15. Preferably, the brush 32 materials and configurations are as provided in FIGS. 1–5 and 6B. The artisan will recognize the various alternatives. The size of the weights 33 and the spring constant K of the elliptical spring 31 should be selected such that when the fan 7 is turned off or operates below its normal speed in the operation of the ionizer A, the brushes 32 are capable of dislodging dirt and dust that has accumulated on the emitter points of the electrodes 8.

Figure 13:
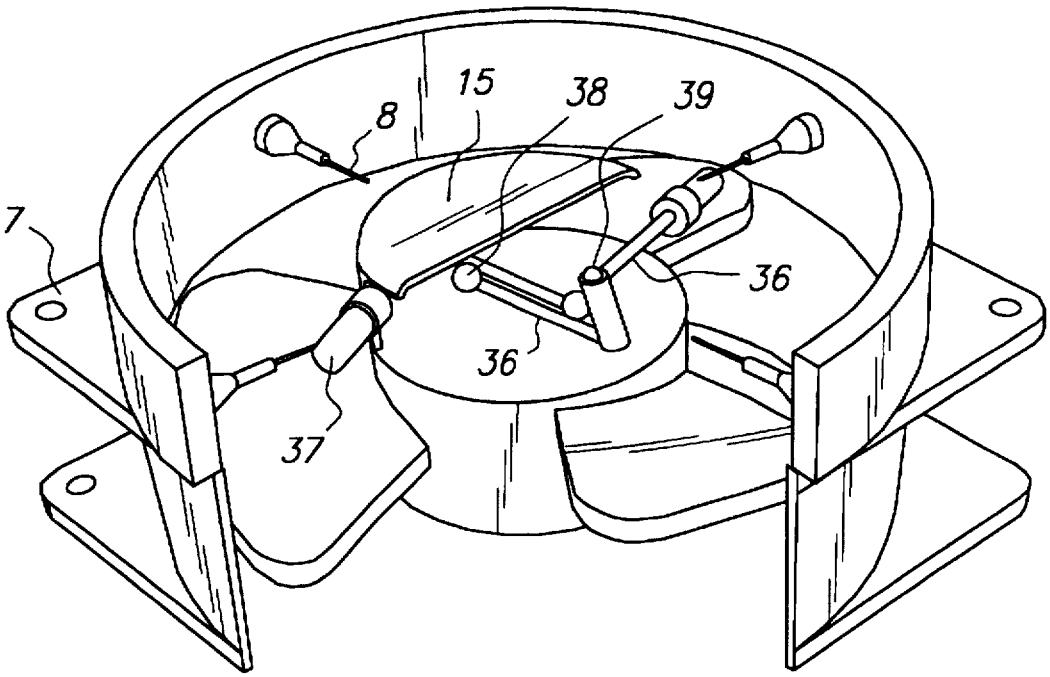
FIG. 13 is a perspective view (and partly broken away) of a third embodiment of the present invention with the fan turned off.

Referring now to FIG. 13, a perspective view (and partly broken away) of a third embodiment of the present invention with the fan 7 turned off is shown. In this embodiment, the cleaning device B includes a pair of two-armed supports 36 with brushes 37 on the end of one arm and weights 38 on the end of the other arm. The supports 36 can rotate around posts 39 which are attached to the cover 15 and inclined to the plane of the electrodes 8. The supports 36 work like pendulums with the axes of the inclined posts 39. The brush 37 materials and configurations are preferably as provided in FIGS. 1–5 and 6B. The artisan will recognize the various alternatives. The size of the weights 38 should be selected such that when the fan 7 is turned off, accelerates from the off condition, or slows down below its normal speed in the operation of the ionizer A, the brushes 37 are capable of dislodging dirt and dust that has accumulated on the emitter points of the electrodes 8.

Figure 14:
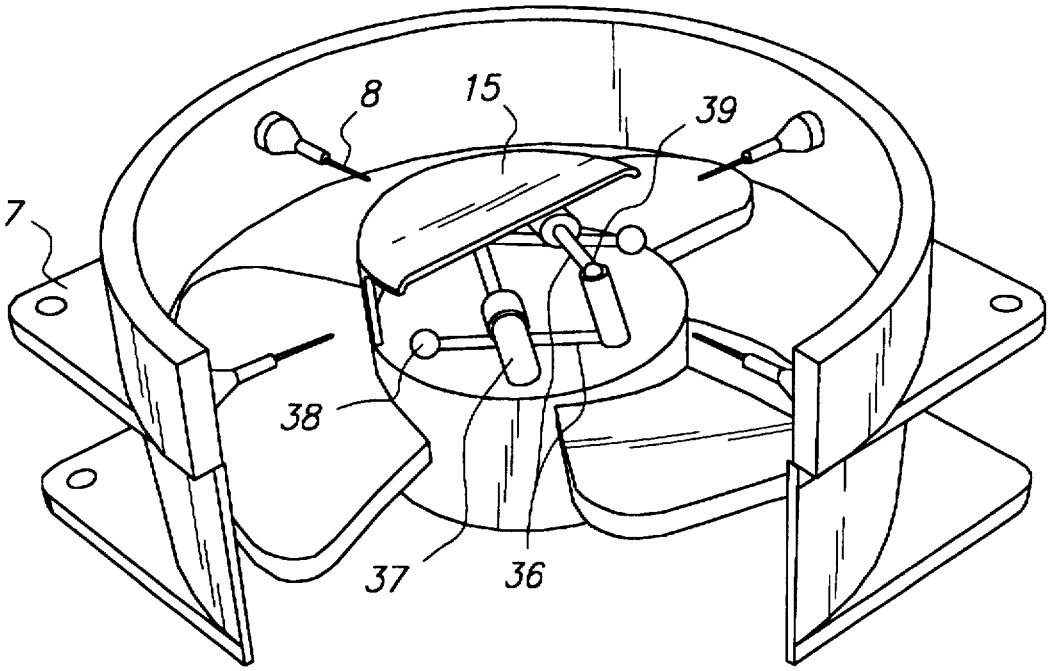
FIG. 14 is the same view as FIG. 13 but with the fan turned on and the propeller rotating at its normal operating speed.

Referring now to FIG. 14, the same view as FIG. 13 but with the fan turned on and the propeller 16 working at its normal operating speed is shown. When the fan 7 is turned off, accelerates, or slows down below the speed of normal operation on the ionizer A, the circle of rotation of the ends of the bristles of the brush 37 overlaps the circle formed by the emitter points of the electrodes 8 and makes possible the sweeping motion of the brush which dislodges dirt from the emitter points of the electrodes 8. At the same time, the weights 38 are positioned close to the axis of rotation of the propeller 16 by the force of gravity. Thus, gravity is the force that provides cleaning in this embodiment. Alternatively, if the fan 7 axis is not vertical, a spring can be used to position the weights 38. When the fan 7 continues to accelerate and gain speed, centrifugal force starts to move the weights 38 out from the axis of rotation of the propeller 16 thereby moving the brushes 37 inward from electrodes 8 and into the cover 15. When the fan 7 rotates with normal operating speed, the brushes 37 are fully inside the cover 15 and the weights 38 rest next to the cover 15.

Although the present invention has been described in considerable detail with reference to certain preferred embodiments thereof, other embodiments are possible. For example, four bar linkage mechanisms of different kinds with brushes and weights installed on the opposite joints can be provided. Additionally, the brushes may be situated on surfaces other then the plane containing the electrodes during ionizer operation. Also, the brushes may or may not stay in the area between the fan hub and body (i.e. fan blades area) after moving out of the area where the emitter points are situated. Furthermore, the brushes may be moved from or toward the area where the emitter points are situated by gravity, centrifugal force, spring force, elasticity of the brush parts or materials themselves, air flow, aerodynamic air lift (caring capacity), and reactions applied to the moving brush assembly by air resistance. These forces may be applied either separately or in arbitrary combination. Therefore, the spirit and scope of the appended claims should not be limited to the description of the preferred embodiments contained herein.

What is claimed is:

1. A cleaning device for automatically cleaning ionizing electrodes in an ionizer that includes a rotating shaft or hub, the cleaning device comprising:

a brush assembly for cleaning the ionizing electrodes;

a first mechanism, coupled to the brush assembly, the first mechanism for responding to a first force such that when the shaft or hub rotates at a first speed the brush assembly is biased towards the ionizing electrodes to provide a cleaning of the ionizing electrodes; and a second mechanism, coupled to the brush assembly, the second mechanism responsive to a second force such that when the shaft or hub rotates at a second speed the brush assembly is biased away from the ionizing electrodes to prevent a cleaning of the ionizing electrodes.

2. The device of claim 1, wherein the first mechanism comprises a spring and the second mechanism comprises a weight.

3. The device of claim 2, wherein the brush assembly comprises a ferrule and a brush.

4. The device of claim 3, wherein the brush is cylindrically shaped.

5. The device of claim 4, wherein the brush assembly retracts within a cover when the shaft or hub rotates at the second speed.

6. The device of claim 2, further comprising a counterweight assembly for dynamically balancing the device during a full cycle of the ionizer operation.

7. A cleaning device for automatically cleaning ionizing electrodes in an ionizer that includes a fan, the cleaning device comprising:

a stand having a hole;

a rod slidably installed and extending through the hole;

a brush assembly positioned at one end of the rod for cleaning the emitter points of the ionizing electrodes;

a restoring mechanism disposed about the rod and positioned on the same side of the stand as the brush assembly for applying a restoring force to the weighted portion so that when the fan rotates at a first speed the restoring force enables the brush assembly to clean the ionizing electrodes; and a weighted portion positioned at the other end of the rod, the weighted portion responsive to a second force such that when the fan rotates at a second speed the second force prevents the brush assembly from cleaning the ionizing electrodes.

8. The cleaning device of claim 7, wherein the brush assembly comprises a brush and a ferrule.

9. The cleaning device of claim 8, further comprising a cover, attached to the stand, the cover having a hole on the same axis as the hole in the stand, the hole having an opening with a sufficient radius to allow the ferrule and the brush to travel outside and inside the cover.

10. The cleaning device of claim 7, wherein the restoring mechanism is a compressible spring.

11. A cleaning device for automatically cleaning ionizing electrodes in an ionizer, wherein the device is mounted atop the propeller of a fan forming part of the ionizer, the cleaning device comprising:

a stand having a hole;

a rod extending through the hole;

a restoring mechanism, having an outer surface and an inner surface, the restoring mechanism disposed about the stand for providing a first force;

a plurality of brush assemblies coupled to the outer surface of the restoring mechanism for cleaning the ionizing electrodes;

a plurality of weighted portions attached to the inner surface of the restoring mechanism and slidably installed about the rod, the weighted portions responsive to a first force provided by the restoring mechanism such that when the fan rotates at a first speed the first force enables the brush assemblies to clean the ionizing electrodes, the weighted portions also responsive to a second force such that when the fan rotates at a second speed the second force prevents the brush assemblies from cleaning the ionizing electrodes.

12. The cleaning device of claim 11, wherein the restoring mechanism is an elliptical spring.

13. The cleaning device of claim 11, wherein the cleaning assembly comprises a brush and a ferrule.

14. A cleaning device for automatically cleaning ionizing electrodes in an ionizer, wherein the device is mounted atop the propeller of a fan forming part of the ionizer, the cleaning device comprising:

a plurality of inclined posts, each post having a spaced-apart relationship to the other inclined posts and inclined to the rotational plane of the propeller;

a plurality of two-arm supports, each support rotatably attached to one of the inclined posts;

a brush assembly attached to the end of one arm of the support for cleaning the electrodes; and a weighted portion at the end of the other arm of the support responsive to a first force such that when the fan rotates at a first speed the first force enables the brush assembly to clean the ionizing electrodes, and when the fan rotates at a second speed a second force prevents the brush assembly from cleaning the ionizing electrodes.

15. The cleaning device of claim 14, wherein the brush assembly includes a brush and a ferrule.

16. The cleaning device of claim 14, wherein the weighted portion is positioned at the axis of rotation of the fan under the force of gravity when the fan rotates at the first speed.

17. The cleaning device of claim 14, wherein the weighted portion is positioned at the axis of rotation of the fan under the force of a spring when the fan rotates at the second speed.

18. In an ionizer including a fan and a cleaning assembly with a brush assembly, a method for automatically cleaning the ionizing electrodes comprising:

automatically responding to a first force such that when the fan rotates at a first speed the first force moves the brush assembly towards the ionizing electrodes to provide a cleaning of the ionizing electrodes; and automatically responding to a second force such that when the fan rotates at a second speed the second force moves the brush assembly away from the ionizing electrodes to prevent a cleaning of the ionizing electrodes.

19. The method of claim 18, further comprising:

retracting the brush assembly within a cover when the fan rotates at the second speed.

20. The method of claim 18, further comprising:

dynamically balancing the cleaning device during a full cycle of the ionizer operation using a counterweight assembly.

21. A cleaning device for automatically cleaning ionizing electrodes in an ionizer, wherein the device is mounted atop the propeller of a fan forming part of the ionizer, the cleaning device comprising:

a cover having a plurality of legs for centering the cover on the top of the propeller;

a stand attached to the cover, the stand having a hole;

a first rod slidably installed and extending through the hole;

a brush positioned at one end of the rod for cleaning the emitter points of the ionizing electrodes;

a weight positioned at the other end of the rod, the weight responsive to a first force so that when the fan rotates at a first speed the first force prevents the brush from cleaning the ionizing electrodes;

a first spring disposed about the rod and positioned on the same side of the stand as the brush for applying a restoring force to the weight so that when the fan rotates at a second predetermined speed the restoring force enables the brush to clean the ionizing electrodes;

a second rod attached to the stand;

a counterweight slidably installed on the second rod for dynamically balancing the cleaning device during the full cycle of the ionizer operation; and a second spring disposed about the second rod and positioned between the counterweight and the stand for applying a restoring force to the counterweight.

* * * * *